United States Patent [19]

Guibault

[11] Patent Number: 4,604,962

[45] Date of Patent: Aug. 12, 1986

[54] MODULAR FLOATING DOCK

[76] Inventor: Denis Guibault, 5285 des Tilleuls St., Montreal, Canada, H1T 2H7

[21] Appl. No.: 695,378

[22] Filed: Jan. 28, 1985

[51] Int. Cl.[4] ..... B63B 3/08

[52] U.S. Cl. ..... 114/266; 14/27; 114/218; 114/219; 404/40

[58] Field of Search ..... 114/266, 77 R, 218, 114/219; 405/212, 215, 219; 14/27; 404/40; 411/84, 85, 103, 104, 119, 120, 123

[56] References Cited

U.S. PATENT DOCUMENTS

| | | | |
|---|---|---|---|
| 90,952 | 6/1869 | Murray | 114/218 X |
| 3,065,003 | 11/1962 | Whitehouse | 114/219 X |
| 375,2102 | 2/1973 | Shuman | 114/267 |
| 382,4644 | 4/1974 | Stranginzer | 14/27 |

FOREIGN PATENT DOCUMENTS

| | | | |
|---|---|---|---|
| 982881 | 2/1976 | Canada . | |
| 102435 | 9/1978 | Canada . | |
| 532830 | 1/1941 | United Kingdom | 411/85 |
| 911869 | 11/1962 | United Kingdom | 114/219 |

*Primary Examiner*—Sherman D. Basinger

[57] ABSTRACT

There is disclosed an interlocking assembly for floating dock units of quadrangular section, comprising eye lugs, outwardly projecting from the four corners of the floating units. The lugs are superposable one over the others at the junction of four adjacent floating units. A bolt is provided, including a head and a threaded spindle with an associated nut. The bolt spindle is engageable through the eye of each lug for connecting the four adjacent floating units. The nut has inturned guide flanges releasably engaging the lowermost lug for holding the nut in register with the lug and for preventing its rotation when the bolt is screwed within the nut. Bumpers and cleats are also provided and secured to exposed lugs around the dock.

4 Claims, 11 Drawing Figures

MODULAR FLOATING DOCK

FIELD OF THE INVENTION

This invention relates to a modular type floating dock and, more specifically, to an interlocking assembly for the floatation units of the dock.

BACKGROUND OF THE INVENTION

Canadian Pat. No. 982,881 dated Feb. 3, 1976 to H. Stanzinger (corresponding U.S. Pat. No. 3,824,644 dated July 23, 1974) discloses floating docks made of a plurality of interlocking units. The interlocking means thereof consist of pins engaging through superposed eye lugs. The conical enlarged heads of the pins have two projections which come into engagement with rounded grooves in the corners of the floating units so as to thus resiliently lock the pin against inadvertent rise out of the eye lugs. Since these pins are resiliently held in locking position, they may eventually become disengaged from the eye lugs in wavy waters. If conventional bolts and nuts were used, a swimmer would need to crawl under the floating dock to hold the nut in position when a second person would screw the bolt from above. This is obviously inconvenient.

OBJECTS OF THE INVENTION

The general object of the invention is to provide an interlocking bolt and nut arrangement for modular floating dock units with means to hold the locking nut in position below the dock to prevent its rotation when screwing the bolt from above. An important object of the present invention is to prevent release of the interlocking arrangement by wave action. Another object of the invention is to provide the above mentioned arrangement for attaching bumpers, cleats and the like to the sides of the dock.

SUMMARY OF THE INVENTION

The interlocking assembly of the invention comprises eye lugs projecting from the corners of the floating units at different levels so that they may be superposed when, for instance, four floating units are joined together, a bolt with an enlarged head and a threaded spindle is inserted from above through the superposed eye lugs and screwed into a nut underlying the lowermost lug.

In accordance with the invention, nut holding anti-rotation means hold the nut in position and prevents its rotation when the bolt is screwed into the nut.

The enlarged conical shape of the head comes into frictional engagement with matching frusto-conical corner surfaces of the floating units and thus positively prevent inadvertent unscrewing of the bolt.

The same lugs are used to attach bumpers and cleats to the sides of the dock. These bumpers and cleats are formed by changing the shape of the above-noted bolt head.

The nut holding and anti-rotation means include a pair of upstanding parallel flanges of L-shape cross-section and protruding from one end face of the nut and slidably engageable into side grooves formed at the top surface of the lowermost lug of each floating unit.

Anti-rotation means are also provided to prevent rotation of the bumpers or cleats when screwed in position by means of a conventional nut, these second anti-rotation means includes ridges formed on the stem of the bumpers and cleats and engageable with corresponding notches formed at the periphery of the eye of the lugs.

DETAILED DESCRIPTION OF THE DRAWINGS

Figure 1:
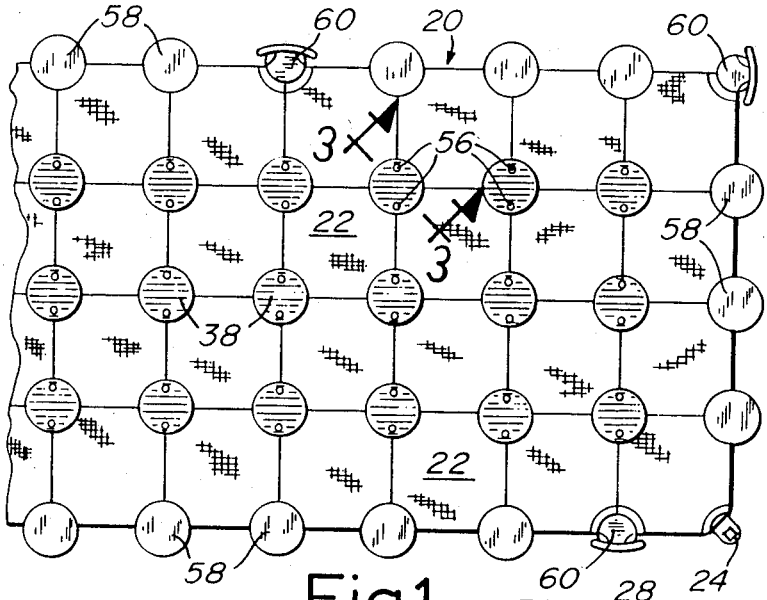
FIG. 1 is a top plan view of the modular floating dock according to the invention.
Figure 2:
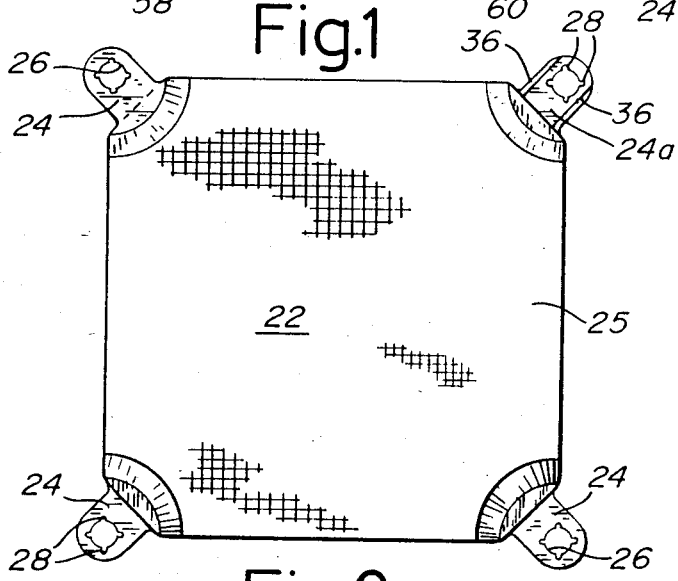
FIG. 2 is a top plan view of one of the floating units forming the dock.

We will first refer to FIGS. 1 and 2 of the drawings.

The floating dock 20 is constituted of a plurality of similar floating units 22. Each floating unit 22 is of polygonal shape and, preferably, square section in which case it comprises four diagonally extending corner eye lugs 24 set at four different levels from the top surface 25 of each unit, each having having four circumferentially spaced notches 28 for a purpose later set forth.

Figure 3:
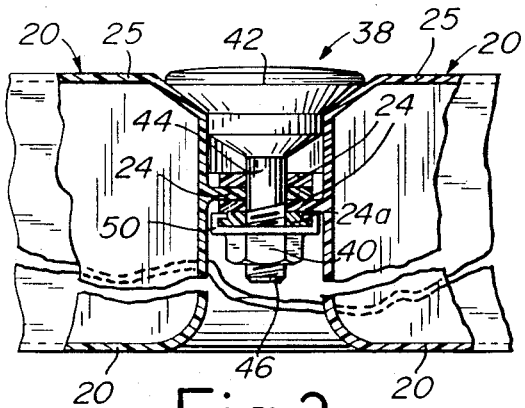
FIG. 3 is a partial cross-section of the floating dock taken along line 3—3 of FIG. 1.
Figure 4:
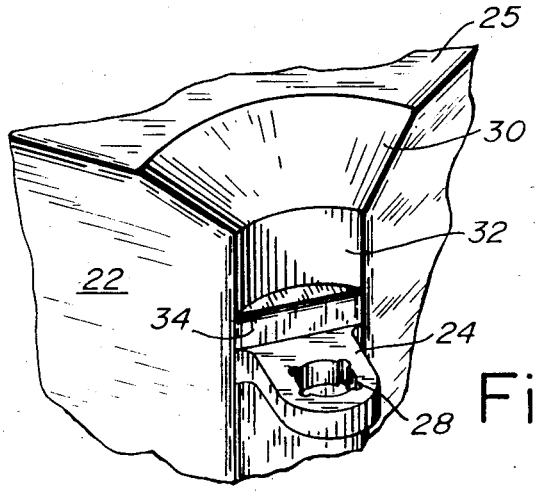
FIG. 4 is a partial perspective view of one corner of a floating unit.
Figure 5:
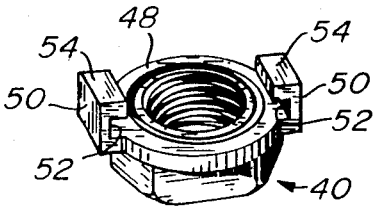
FIG. 5 is a perspective view of the nut to be attached to the lug of FIG. 4*a;*
Figure 4A:
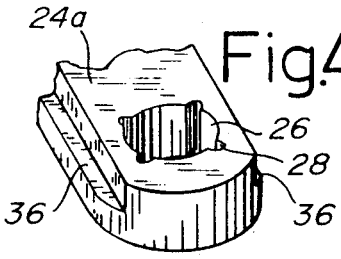
FIG. 4*a* is a perspective view of the lowermost eye lug.
Figure 6:
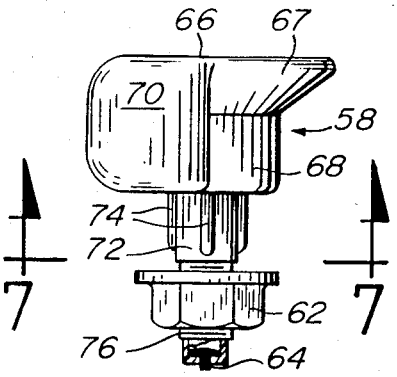
FIG. 6 is an elevation of a bumper assembly.
Figure 8:
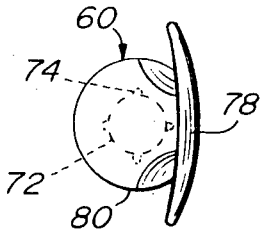
FIG. 8 is a top plan view of a cleat.
Figure 7:
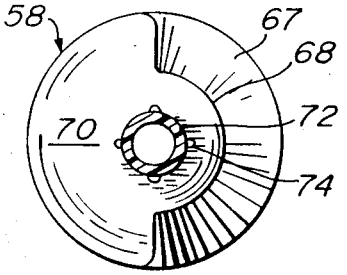
FIG. 7 is a cross-section taken along line 7—7 of FIG. 6.
Figure 9:
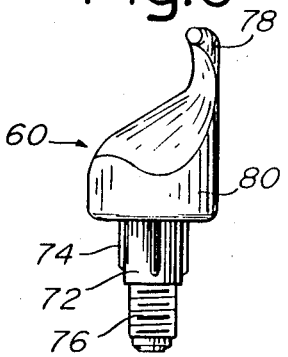
FIG. 9 is a side elevation of the cleat of FIG. 8.
Figure 10:
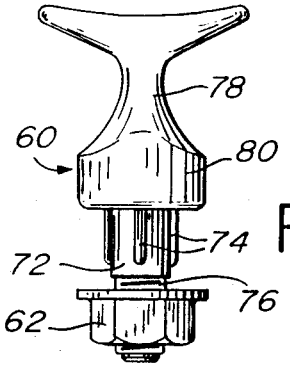
FIG. 10 is a front elevation of the cleat assembled with its nut.

Each floating unit 22 is water-proof and preferably hollow and may be moulded out of synthetic resins such as high density polyethylene. A plastic foam may fill each unit 22. Each top corner of each unit 22 forms a concave and inclined frusto-conical surface 30 which is followed by a partly-cylindrical surface portion 32, in turn followed by a flat surface 34 from which horizontally extends a lug 24. Surface 34 is set at 45° from the adjoining side surfaces of the units so that, in practice, each lug 24 extends diagonally of the floating unit 22. The lowermost lug 24*a* is provided with longitudinally extending and parallel lateral grooves 36 formed at the top of the lug. A bolt 38 and a corresponding nut 40 are provided. Bolt 38 is preferably also made of synthetic resin and is hollow and has a generally frusto-conical head 42 adapted to match and fit on the concave frusto-conical surface portion 30 of the four adjacent units 22 interconnected by the bolt 38. Depending from head 42 is a hollow spindle 44 which has external threads 46 at the lower portion thereof. Spindle 44 is long enough to extend past through the superposed four lugs and past the lowermost lug 24*a*. The nut 40 is of standard construction but is characterized by an integral ring 48 at one end face thereof, said ring 48 forming a pair of diametrically opposite and parallel upstanding flanges 50 of L-shape cross-section defining guide slots 52. The thickness of the internal top portion 54 of the flanges 50 is at the most equal to the depth of the grooves 36 of the lowermost eye lug 24A. Nut 40 is first slipped in position on the lowermost lug 24A with the top parts 54 of the flanges 50 engaging the respective grooves 36 of the lug 24A. The sliding arrangement has preferably a friction fit so that the nut may be held in register with the eye 26 of the lug 24A. Then it is a simple matter to assemble four adjacent floating units 22 with four eye lugs in superposed position as shown in FIG. 3 and then to insert from above the bolt 38 and screw said bolt within the nut 40 which is not only held in position underneath the dock but is also held against rotation during screwing of the bolt. Screwing of the bolt is achieved with a suitable tool engaging the spaced holes 56 formed at the top surface of the bolt head 42 because the top parts 54 of the flanges 50 do not protrude above the top surface of the lowermost lug but are preferably flush with the same, the lowermost lug with the nut forms a full size surface for resisting the downward pressure of the remaining lugs when a load rests on the units associated with the lugs 24.

The floating units 22 may be assembled to form a dock of any size and/or shape. The exposed sides of the assembled units have exposed lugs 24 or 24A which may be used to attach bumpers and/or cleats as shown at 58 and 60 respectively. These bumpers and cleats are adapted to be secured either to one lug at a corner of the dock or to two superposed lugs 24, or 24 and 24A at the junction of two adjacent floating units 22 by means of standard nuts 62. The bumpers and cleats are of a hollow construction and moulded of synthetic resin but the bumpers 58 have a somewhat flexible wall and are designed to be filled with gas under pressure through a one-way valve 64 of conventional construction located at the bottom end of the bumper.

Bumper 58 has an enlarged head 66 and a co-axial pin or spindle 72. One half portion of the head 66 is of generally frusto-conical shape as shown at 67 downwardly followed by a cylindrical half portion 68. Portions 67 and 68 of the bumper are adapted to fit the corresponding surface portions 30 and 32 at the corners of two adjacent floating units 22. The other half portion of the head 66 indicated at 70 is of generally half-cylindrical shape having a diameter corresponding to the maximum diameter of the head 66. This cylindrical half portion 70 is adapted to protrude from the side edge of the dock. The bumper has a spindle 72, the top portion of which is provided with longitudinal equally radially spaced ridges 74, adapted to have a sliding fit with the notches 28 of the eye 26 of any one of the lugs 24 and 24A. The lower portion of the spindle 72 is threaded as shown at 76 to be screwed within the nut 62. A one-way valve 64 is fitted within the free end of the spindle 72. The bumper once inserted through one or two lugs at a corner of the dock or along the sides of the dock is held against rotation by the ridges 74 which engage the notches 28 and therefore it is a simple matter to screw the nut 62 by means of a suitable tool such as a wrench because these nuts are accessible along the sides of the dock.

The cleats 60 have a head 78 in the form of a cleat with a lower cylindrical wall 80 adapted to fit against the cylindrical surface portions 32 at the corners of the floating units 22. A cleat is further provided with a spindle 72, ridges 74 and threaded portion 76 as for the bumpers 58 and are therefore secured to the lugs in the same manner as the bumpers.

What I claim is:

1. A floating dock comprising a plurality of similar floating units detachably interconnected, each floating unit comprising a floatable substantially polygonal body provided with bevelled corners, eye lugs horizontally projecting from each corner at different levels for overlapping with eye lugs of adjoining floating units linked therewith, the lowermost lug of each floating unit having lateral and parallel longitudinally-extending grooves at the top longitudinal corners thereof, a bolt having an externally-threaded spindle portion insertable through the registering eyes of at least two superposed lugs of adjacent floating units, a nut screwable on said bolt spindle from underneath the lowermost lug of superposed lugs, said nut having upstanding parallel flanges, of L-shape cross-section, slidably engageable within said grooves of said lowermost lug, said flanges holding said nut onto said lowermost lug and preventing said nut from rotating with respect to said lowermost lug, each corner of said floating unit forming a top concave and downwardly-converging surface portion, and said bolt having an enlarged head, of generally frusto-conical shape, matching and frictionally engaging said top concave corner surface portions, each lug having at least one notch extending across the periphery of the eye thereof, some of said lugs being exposed along the sides of said dock, and further including bumpers attached to at least some of said exposed lugs, said bumpers including a threaded spindle and an enlarged head, said spindle adapted to extend through the eye of said exposed lugs and attached thereto by a nut screwed on the threaded spindle of the bumper; a portion of said bumper spindle having at least one longitudinal ridge slidably fitting within the notch of the eye lug to prevent its rotation during screwing of said last-named nut, the bumpers forming an enlarged head for said spindle, said enlarged bumper head defining a half-portion with a frusto-conical part adapted to fit against the matching top concave corner surface portions of two adjacent floating units, the other half-part of the humper head being of generally half-cylindrical shape and protruding from the side of the dock.

2. A floating dock comprising a plurality of similar floating units detachably interconnected, each floating unit comprising a floatable substantially polygonal body provided with bevelled corners, eye lugs horizontally projecting from each corner at different levels for overlapping with eye lugs of adjoining floating units linked therewith, the lowermost lug of each floating unit having lateral and parallel longitudinally-extending grooves at the top longitudinal corners thereof, a bolt having an externally-threaded spindle portion insertable through the registering eyes of at least two superposed lugs of adjacent floating units, a nut screwable on said bolt spindle from underneath the lowermost lug of superposed lugs, said nut having upstanding parallel flanges, of L-shape cross-section, slidably engageable within said grooves of said lowermost lug, said flanges holding said nut onto said lowermost lug and preventing said nut from rotating with respect to said lowermost lug, each corner of said floating unit forming a top concave and downwardly-converging surface portion, and said bolt having an enlarged head, of generally frusto-conical shape, matching and frictionally engaging said top concave corner surface portions, each lug having at least one notch extending across the periphery of the eye thereof, each corner of said floating units having a partially cylindrical corner surface portion downwardly depending from said top concave surface portion, and further including a cleat having a spindle formed with at least one longitudinal ridge adapted to fit the notch of the eye of an exposed lug and held against rotation, said spindle having a lower externally-threaded portion adapted to threadedly receive a nut, said cleat having a head formed as a cleat and including a lower cylindrical portion adapted to fit against the matching partially cylindrical corner surface portions of two adjacent floating units.

3. A floating dock comprising a plurality of similar floating units detachably interconnected, each floating unit comprising a floatable substantially polygonal body provided with bevelled corners, eye lugs horizontally projecting from each corner at different levels for overlapping with eye lugs of adjoining floating units linked therewith, a bolt insertable through the registering eyes of four superposed lugs of four adjacent floating units, a nut screwable on said bolt from underneath the lowermost lug of superposed lugs, said nut having coupling means engageable with said lowermost lug to hold said nut onto said lowermost lug and prevent said nut from rotating with respect to said lowermost lug, each corner of said floating units forming a top concave and downwardly-converging surface portion and said bolt having an enlarged head of generally frusto-conical shape, matching and frictionally engaging said top concave corner surface portion, each lug having at least one notch extending across the periphery of the eye thereof, some of said lugs being exposed along the sides of said dock, and further including bumpers attached to at least some of said exposed lugs, said bumpers including a threaded spindle and an enlarged head, said spindle adapted to extend through the eye of said exposed lugs and attached thereto by a nut screwed on the threaded spindle of the bumper; a portion of said bumper spindle having at least one longitudinal ridge slidably fitting within the notch of the eye lug to prevent its rotation during screwing of said last-named nut, the bumpers forming an enlarged head for said spindle, said enlarged bumer head defining a half-portion with a frusto-conical part adapted to fit against the matching top concave corner surface portions of two adjacent floating units, the other half-part of the bumper head being of generally half-cylindrical shape and protruding from the side of the dock.

4. A floating dock comprising a plurality of similar floating units detachably interconnected, each floating unit comprising a floatable substantially polygonal body provided with bevelled corners, eye lugs horizontally projecting from each corner at different levels for overlapping with eye lugs of adjoining floating units linked therewith, a bolt insertable through the registering eyes of four superposed lugs of four adjacent floating units, a nut screwable on said bolt from underneath the lowermost lug of superposed lugs, said nut having coupling means engageable with said lowermost lug to hold said nut onto said lowermost lug and prevent said nut from rotating with respect to said lowermost lug, each corner of said floating units forming a top concave and downwardly-converging surface portion and said bolt having an enlarged head of generally frusto-conical shape, matching and frictionally engaging said top concave corner surface portion, each lug having at least one notch extending across the periphery of the eye thereof, each corner of said floating units having a partially cylindrical corner surface portion downwardly depending from said top concave corner surface portion, and further including a cleat having a spindle formed with at least one longitudinal ridge adapted to fit the notch of the eye of an exposed lug and held against rotation, said spindle having a lower externally-threaded portion adapted to threadedly receive a nut, said cleat having a head formed as a cleat and including a lower cylindrical portion adapted to fit against the matching partially cylindrical corner surface portions of two adjacent floating units.

* * * * *